United States Patent [19]

Sutton et al.

[11] 4,453,863

[45] Jun. 12, 1984

[54] TRENCH SHORING DEVICE

[75] Inventors: Russell L. Sutton, Humble, Tex.; George Bradberry, Hebert, La.

[73] Assignee: Safety Lights Sales & Leasing, Inc., Houston, Tex.

[21] Appl. No.: 343,541

[22] Filed: Jan. 29, 1982

[51] Int. Cl.[3] ..... E02D 17/08; E04G 25/00

[52] U.S. Cl. ..... 405/282; 405/142; 254/93 R

[58] Field of Search ..... 405/142, 149, 272, 282, 405/283; 248/354 H, 357

[56] References Cited

U.S. PATENT DOCUMENTS

| | | | |
|---|---|---|---|
| 3,224,201 | 12/1965 | Brunton | 405/282 |
| 3,230,720 | 1/1966 | Bennett | 405/282 |
| 3,791,151 | 2/1974 | Plank | 405/282 |
| 4,279,548 | 7/1981 | Ramey | 405/282 X |

FOREIGN PATENT DOCUMENTS

| | | | |
|---|---|---|---|
| 644304 | 7/1962 | Canada | 405/282 |
| 1059359 | 6/1959 | Fed. Rep. of Germany | 405/282 |
| 2207319 | 8/1973 | Fed. Rep. of Germany | 405/282 |
| 3004923 | 8/1981 | Fed. Rep. of Germany | 405/282 |

*Primary Examiner*—Cornelius J. Husar

*Assistant Examiner*—Nancy J. Stodola

*Attorney, Agent, or Firm*—Vaden, Eickenroht, Thompson, Bednar & Jamison

[57] ABSTRACT

There are disclosed two embodiments of a trench shoring device of the type having rails which are forced against the sides of the trench by one or more fluid actuated, extendible and retractible braces connected to and extending between the rails. In one embodiment, the rails extend vertically within the trench, and the opposite ends of the braces are so connected to the vertical rails that they may be swung folded positions during lowering into and raising from the trench. In another embodiment of the invention, the rails extend horizontally of the trench, and the ends of the braces are connected thereto in such a manner as to prevent substantial movement of the braces out of perpendicular positions with respect to the rails. In each embodiment, the rails are of "I"-beam shape including a relatively wide outer flange and a relatively narrow inner flange connecting the web, and the connections of the ends of the braces to the rails are of such construction as to transfer the load of the brace to the inner flange of each rail, and thus through the web of the rail to the outer flange, as well as directly to the outer flange.

2 Claims, 10 Drawing Figures

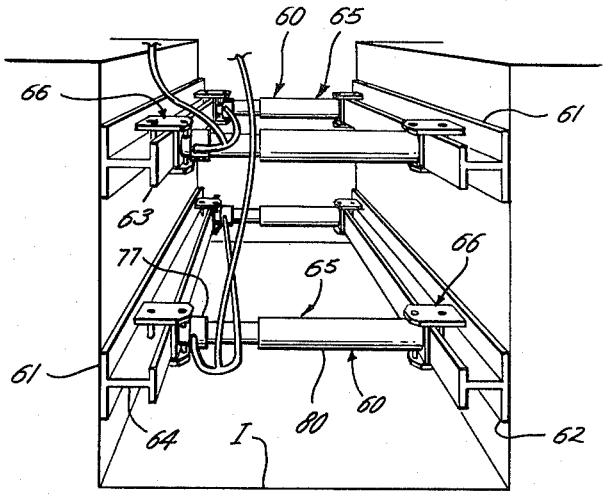
Fig. 6
Fig. 7
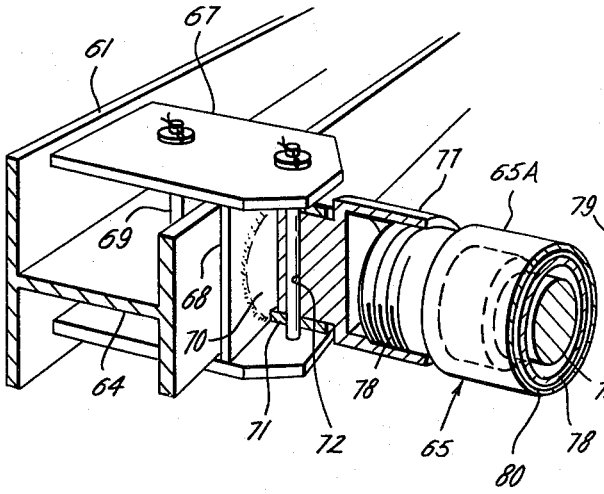
Fig. 8
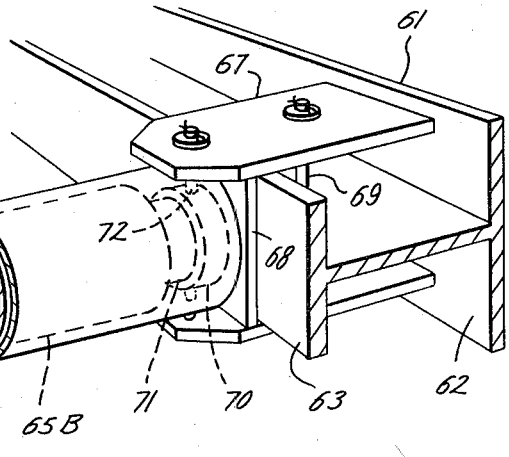

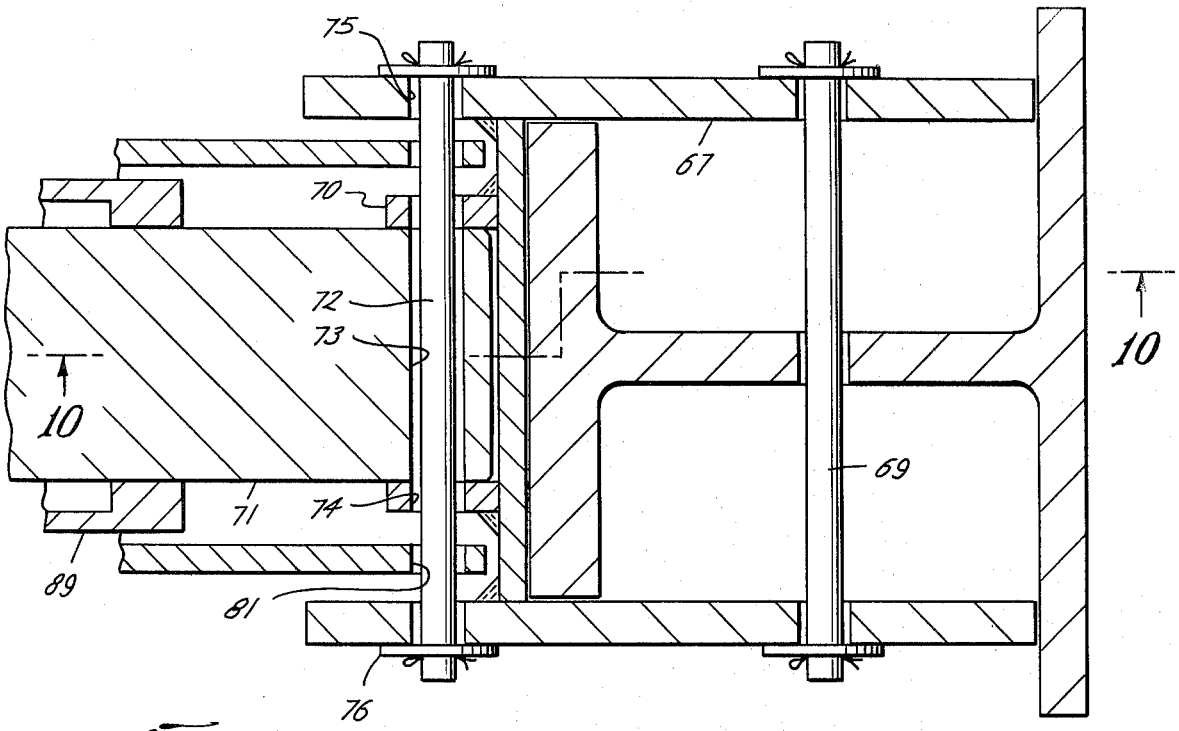
Fig. 9
Fig. 10
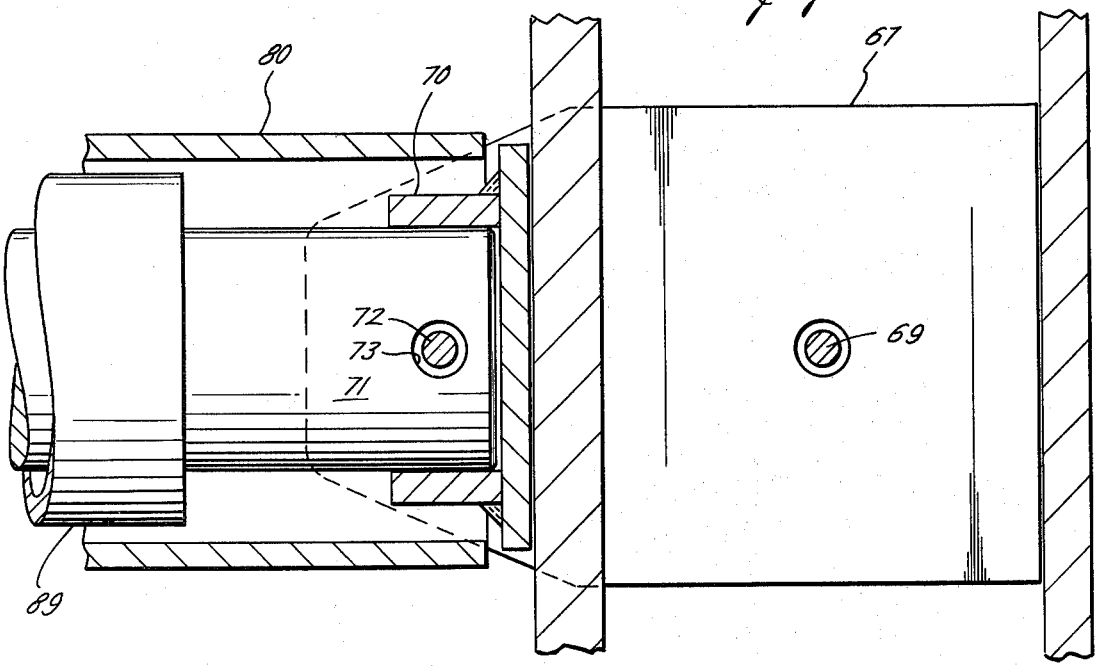

TRENCH SHORING DEVICE

This invention relates generally to trench shoring devices; and, more particularly, to improvements in trench shoring devices of the type having rails which are forced against the sides of the trench by one or more fluid-actuated, extendible and retractible braces connected to and extending between the rails.

As shown, for example, in U.S. Pat. Nos. 3,224,201 and 3,230,720 the rails of such devices may extend vertically within the trench, with successive devices being spaced apart lengthwise of the trench. If this spacing interferes with laying pipe of substantial lengths, the rails may instead extend horizontally along the sides of the trench. In either case, the rails are generally connected lengthwise of the device by two or more parallel braces.

The braces of the devices shown in the aforementioned patents are pivotally connected at each end to the vertical rails so that they may be folded into a shape which enables a single individual to grasp the upper ends of both rails in lowering them into or lifting them from the trench. On the other hand, since the horizontally disposed devices are handled by machine, their braces are normally fixed at each end in perpendicular relationship to the rails.

In any event, the rails of these prior devices have been made of flat plates or shallow channels having flanges on their inner sides to which the ends of the braces are connected. In some cases, the load of the hydraulic force of the braces is transferred to the rails by pads on the ends of the braces for engagement with corresponding areas on the webs of the rails intermediate the flanges. However, this force may be so large as to cause the web to fail, or bend the pad into a shape in which its side edges fold up away from the side of the trench. In other devices, when this load is transferred to the rails through pins extending laterally across the rails, the large concentration of force on the pins may cause them to fail in shear. Furthermore, since the rails are not of standard shape, they may be expensive to produce, and, in some cases at least, the connections of the opposite ends of the braces to the rails, including the load transfer pads, may be of different construction, thereby increasing inventory requirements.

An object of this invention is to provide such devices in which the rails are of such shape and so connected to the ends of the braces as to have greater load bearing capacity, and to more uniformly apply the load of the braces, than those above described.

Another object is to provide such a device in which the connections of both ends of the braces to the rails are identical and thus interchangeable, end for end, so as to reduce inventory requirements.

These and other objects are accomplished in accordance with the illustrated embodiments of the invention, by devices of the type described in which the means for releasably connecting one section of each brace to one rail and the other section to the other rail for disposal perpendicularly therebetween includes means which, upon lowering of the device into the trench and the supply of pressure fluid into the pressure chamber of the brace to extend the brace, transmits the load of the brace from the ends of the brace sections to the inner flanges of the rails, and thus to the outer flanges through the webs of the rails, as well directly to the outer flanges of the rails, so that the outer flanges of the rails are urged tightly against the sides of the trenches. In one such embodiment, the connecting means includes means for maintaining the brace substantially perpendicularly to the rails, when the brace is extended, but permitting the brace to swing into and out of folded position with respect to the rails when pressure fluid is exhausted from the chamber. In the other embodiment of the invention the connecting means includes means for maintaining the brace substantially perpendicularly to the rails when the brace is extended as well as when pressure fluid is exhausted from the chamber.

More particularly, each such connecting means comprises a support pad of generally "H"-shape having side flanges connected by a web, means for releasably mounting the pad on the rail with its web extending laterally across and adjacent the inner side of the inner flange of the rail and its side flanges extending past the end edges of the inner flange of the rail to dispose their outer edges adjacent the inner side of the outer flange of the rail. More particularly, there is a socket on the inner side of the web of the pad to receive the adjacent end of the brace section, and means are provided for releasably connecting the end of the brace section to the support pad, when such ends are so received in the socket, whereby, upon extension of the brace, the ends of the brace section are forced against the webs of the support pads and the webs of the support pads are forced against the inner flanges of the rails. Thus, as above mentioned, the load of the brace is transferred to the outer flanges of the rails through both the webs of the rails and the side flanges of the pads.

The first mentioned embodiment includes a load transfer block on the outer end of the socket to dispose its inner side adjacent the end of the brace section, and the outer side of the block has a flat portion which is essentially flush with the outer side of the web of the pad, when the brace is perpendicular to the rails, and a curved section which permits the block to rotate with respect to the pad as the brace is swung into and out of folded position. In the second mentioned embodiment, the socket is mounted directly on the inner side of the web of the pad, and the end of the brace section is flat and disposable essentially flush with the outer side of the web of the pad so as to maintain the brace essentially perpendicularly to the rails.

Preferably, each support pad is connected to the rail by means of pins which extend loosely through holes in the side flanges of the support pad and the web of the rail, and the ends of the brace sections are connected to the support pads by means of pins which extend loosely through the socket of the support pad and a reduced end of the brace section. Hence, the pins are free to move within the holes as the ends of the brace sections are extended and caused to move relative to the support pad, and the support pad caused to move relative to the rail, whereby there is little if any shear load imposed upon the pins as the rails are urged tightly against the sides of the trench.

Preferably, the means for connecting the end of each brace section to a rail, including the support pads, and in the case of the first mentioned embodiment, the load transfer blocks, are identical to one another, whereby the parts are interchangeable one for the other. As illustrated, and as ordinarily the case, there are two or more braces connected to the rails in parallel relation along the length of the device.

In the drawings, wherein like reference characters are used throughout to designate like parts:

FIG. 6 is a perspective view of a pair of devices which are constructed in accordance with another embodiment of the invention disposed within a trench to enable their horizontal rails to be forced against the sides of the trench;

FIG. 7 is a perspective view of the connection of the left hand rail of one of the devices of FIG. 6 to the left hand end of one of the braces thereof, with parts thereof being broken away in part;

FIG. 8 is a perspective view of the connection of the right hand rail of one of the devices of FIG. 6 to the right hand end of the one brace thereof, with parts thereof being shown in broken lines;

FIG. 9 is an enlarged horizontal sectional view of the connection of the right hand rail to the right hand end of the brace of the device of FIGS. 6 to 8; and FIG. 10 is an enlarged vertical sectional view of the connection of the rail and brace of FIG. 9, as seen along broken lines 10—10 of FIG. 9.

Figure 1:
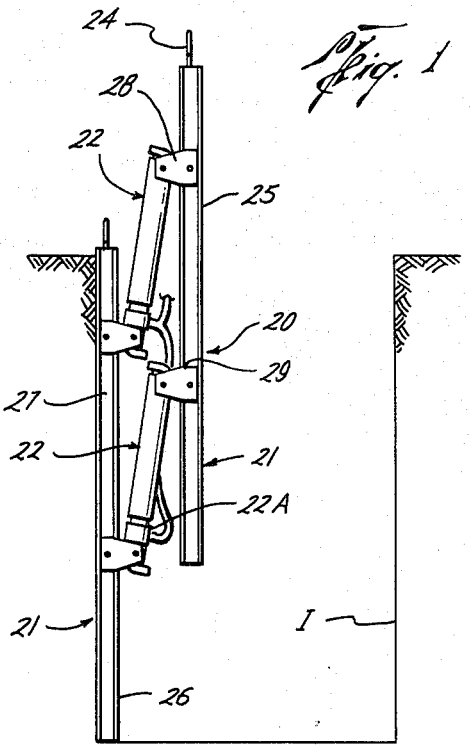
FIG. 1 is a cross-sectional view of a device which is constructed in accordance with one embodiment of the present invention and which has been lowered into a trench in a folded condition.
Figure 2:
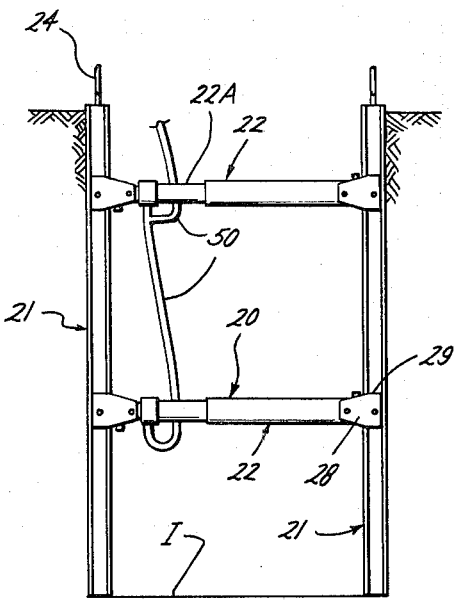
FIG. 2 is a view similar to FIG. 1, but upon unfolding of the rails and extension of the braces to force the vertical rails tightly against the sides of the trench.

With reference now to the details of the above-described drawings, the first described embodiment of the device, which is indicated its entirety in FIGS. 1 and 2 by reference character 20, comprises a pair of rails 21 which are of identical construction, and a pair of braces 22 which are also of identical construction and which extend parallel to one another for connection at their opposite ends to the vertical rails. More particularly, the ends of the braces are connected to the ends of the rails by means, which permits the braces to be swung between positions in which they are disposed generally perpendicularly to the rails, as shown in FIG. 2, and positions in which they are disposed at acute angles with respect to the rails, as shown in FIG. 1. In this latter, folded position of the device, handles 24 at the upper ends of the rails may be grasped by an individual to permit the device to be lowered into or lifted from the trench T. As will be described to follow, the means for connecting each end of the brace to one of the rails is also of identical construction.

As previously described, and as shown in the drawings, each rail is of "I"-beam shape having an outer, relatively wide flange 25 and a relatively narrow, inner flange 26 having their midportions connected by a web 27. The connecting means comprises a generally "H"-shaped support pad 28 having side flanges 29 connected by welds to a web 30. As shown, the web is of a width which is just greater than that of the inner flange 26 of the rail so that the flanges may extend past the side edges of the inner flange to dispose their outer end edges closely adjacent the inner side of the outer flange 25 of the rail. More particularly, the web is so located intermediate the inner and outer edges of the flanges 29 of the support pad 23 that its outer side is disposable closely adjacent the inner side of the inner flange 26 of the rail when the outer edges of the side flanges are closely adjacent the inner side of the outer flange 25.

The support pad is releasably mounted on the rail by means of pins 31 which extend loosely through holes 32 in the side flanges of the support pad and a hole 33 in the web 27 of the rail. The head of each pin bears against the outer side of one side flange, and a washer is held tightly against the outer side of the other flange of the support pad when a nut 34 is made up on the threaded end of the pin.

Each connecting means also includes a transfer block 35 which, as shown, comprises a relatively thick plate 36 having a socket 37 welded to its inner side and an outer side for disposal closely adjacent the inner side of the web of the support pad. Thus, as shown, a pin 38 extends loosely through holes 39 in the side flanges of the support pad as well as through holes 40 in the socket 37 so as to support the outer side of the block in such position.

As shown, with the support pads mounted on the rails so as to be disposed opposite one another, when the device is unfolded, sockets 37 are arranged to receive the reduced diameter ends 41 of the perpendicular braces. More particularly, each such end of the brace has a hole 42 through which the bolt 38 extends loosely so as to releasably connect such end of the brace to the transfer block, and thus to the support pad and rail.

As shown, pin 38 is similar to pin 31 in that an enlarged head at one end is held tightly against one flange of the pad by means of a nut 43 bearing against the other flange. Also, a ring 44 is welded to the inner side of the transfer block 36 within socket 37 to dispose its inner end closely adjacent the end surface of the reduced diameter end 41 of the brace.

Figure 4:
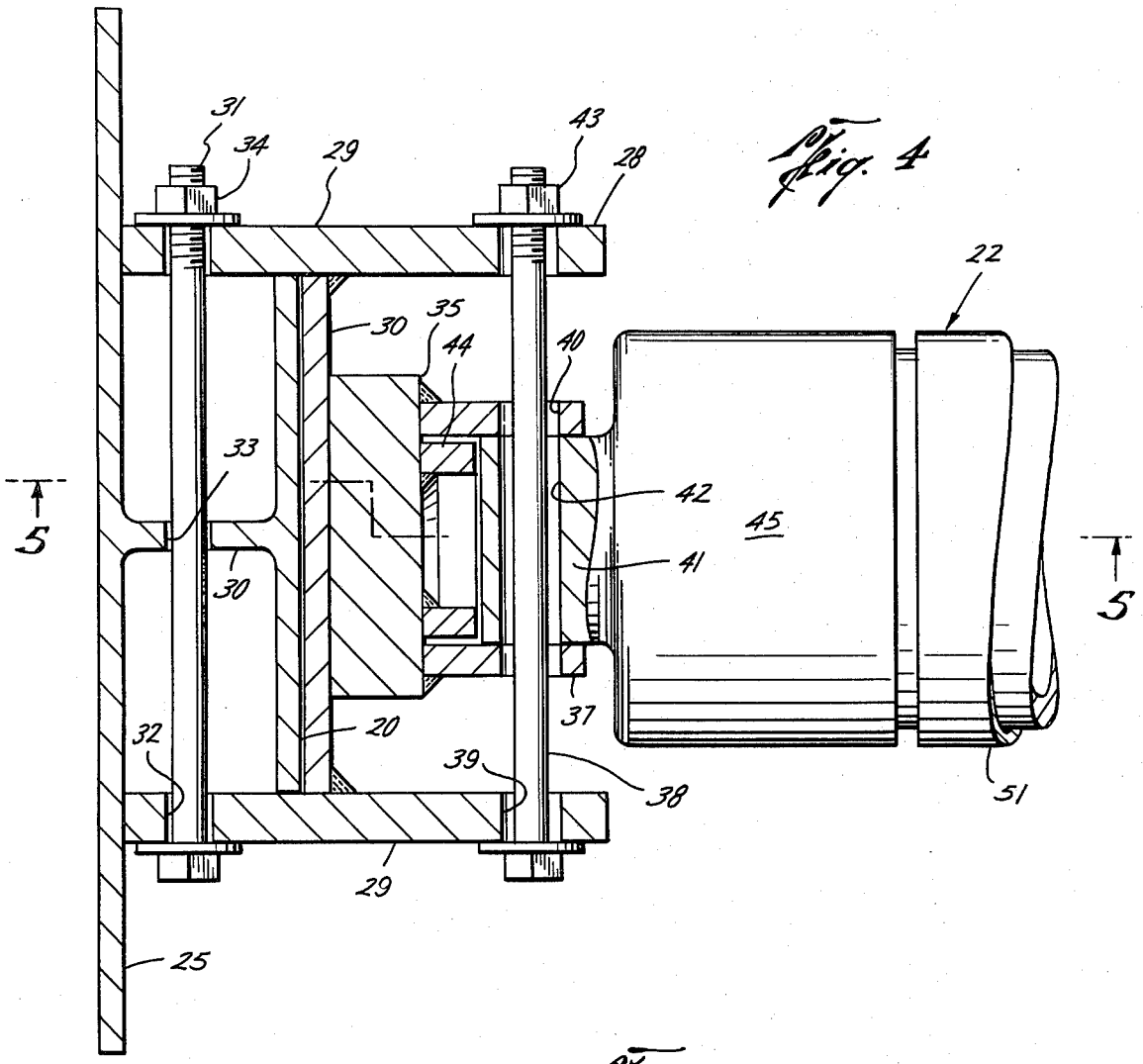
FIG. 4 is a further enlarged horizontal sectional view of the connection of the left hand rail and left end of one of the braces of the device of FIGS. 1 to 3, when unfolded but prior to the application of pressure fluid to extend the brace.
Figure 5:
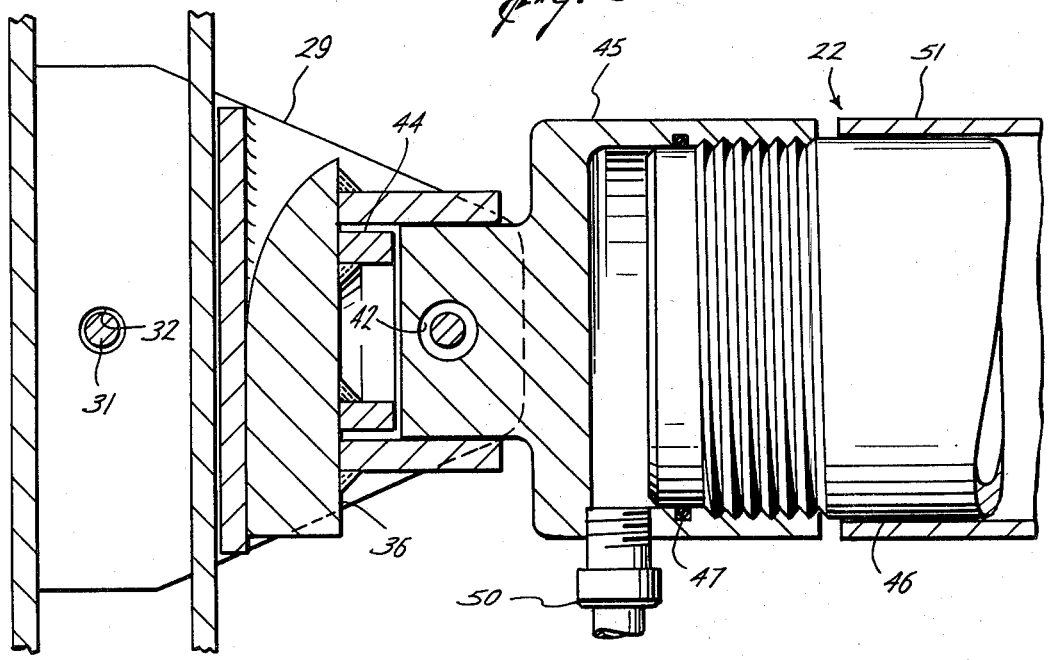
FIG. 5 is a vertical sectional view of the connection of the rail and brace of FIG. 4, as seen along broken lines 5—5 thereof.

As shown in FIGS. 4 and 5, the brace has not been extended by the introduction of pressure fluid into a variable volume chamber therein, as will be described to follow. However, when the brace is extended, each outer end 41 bears against the adjacent inner end surface of ring 44 so as to transfer load to the transfer block 35, which in turn transfers such load to the web 30 of the support pad. In this way, the load is transmitted through the side flanges 29 of the support pad to the outer flange 25 of the rail, as well as to the mid portion of the outer flange by the inner narrow flange 26 of the rail through the web 30 of the rail. Thus, the load is not only distributed over a relatively large area of the rail, but also to a structure which is inherently strong and resistant to failure. Additionally, the bearing of flange 29 on the relatively wide flange at a location intermediate the web 27 and the end edges of the wide flange prevent the wide flange from folding as load is applied through the web 30 to the midportion of the wide flange. Furthermore, during this time, the parts described are free to move relatively short distances relative to one another without imposing shear loads on the pins 31 and 38.

Figure 3:
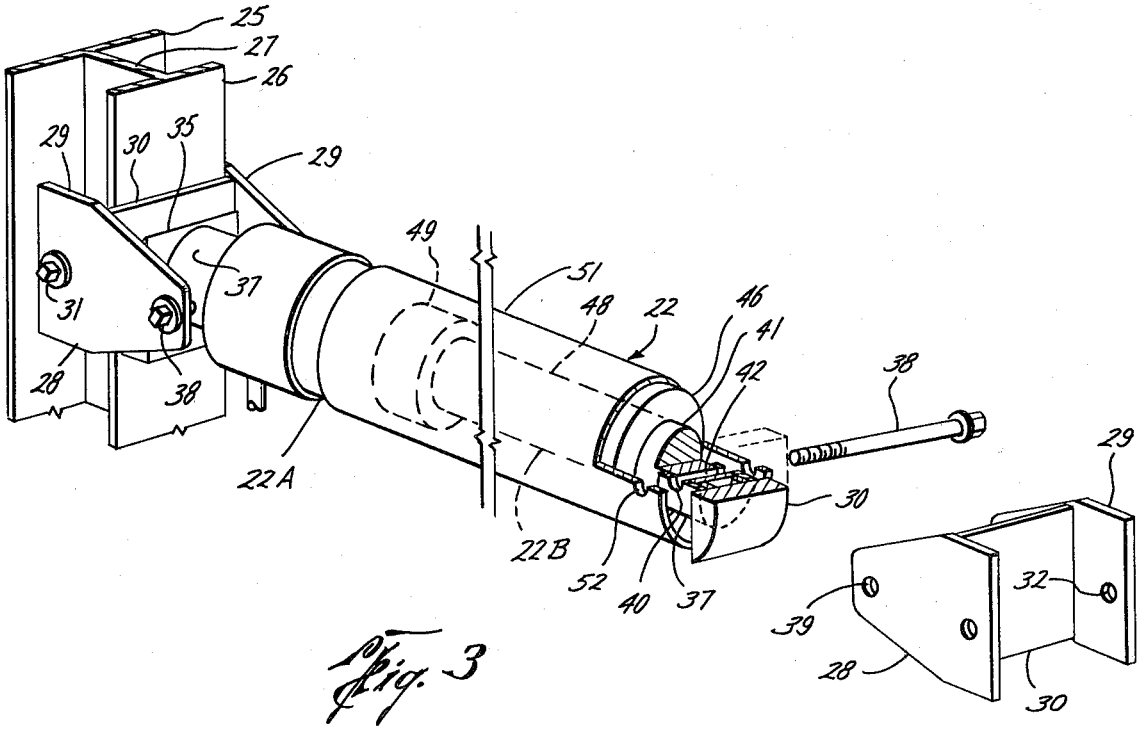
FIG. 3 is an enlarged, perspective view of portions of the device of FIGS. 1 and 2, including the connection of the left hand rail to one end of one of the braces, and the means by which the opposite end of the one brace is connected to the right hand rail, with parts thereof shown in exploded fashion and others broken away in part.

Each of the braces is made up of axially extendible and retractible sections one of which has a cylinder and the other of which has a piston sealably slidable in the cylinder. Thus, as best shown in FIGS. 3 to 5, the left hand section 22A of brace 22 comprises an end cap 45 having the reduced end 41 formed on its outer end so as to be received within socket 37, and a cylinder sleeve 46 threadedly connected to the enlarged inner end of the cap and sealed with respect thereto by means of an O-ring 47 for extension toward the outer end of the brace. The right hand brace section 22B includes a rod 48 whose outer end 42 is adapted to fit within the socket 37 of the right hand transfer block means 23, and a piston 49 on the inner end of the rod which is sealably slidable within the cylinder 46 to form a pressure chamber within the brace between the left hand side of the piston and the cap 45 of the cylinder section 22A of the brace. Pressure fluid is admitted to or exhausted from the chamber of each brace by means of a hose 50 connecting with the cap 45 of each adjacent the reduced end 42 thereof.

As best shown in FIG. 3, the right hand end of the cylinder 46 is reduced to fit closely about the rod 41 to the left of its connection to transfer block 35 in order to close off the space about the rod, and thus protect the sealing surface of the cylinder within which the piston 49 is slidable. In addition, a guard sleeve 51 surrounds the cylinder so as to protect it against damage during handling of the device. As shown, a substantial portion of the left end of the guard sleeve fits over the outer diameter of the cylinder 46, and the right hand end thereof is connected to brace connecting means 33 as well as the brace itself by means of pin 38 whose outer ends extend loosely through holes 52 of the sleeve. More particularly, the sleeve is of a diameter somewhat less than the space between the flanges 29 of support pad 28, and the holes 52 are aligned with those in the flanges 29 as well as holes 40 and 42 in the transfer block and the reduced end 41 of the right hand brace section.

Each of a pair of devices constructed in accordance with an alternative embodiment of the invention, and shown in FIG. 6 to be disposed one above the other within a trench T, is indicated in its entirety by reference character 60 to comprise a pair of horizontally extending rails 61 of substantially the same construction as that of the first described embodiment. Thus, each rail comprises an outer, relatively wide flange 62, and a relatively narrow inner flange 63 connected to the wide flange by web 64.

As previously described, each of the devices of FIGS. 6 to 10 is also similar to that of the previously described device in that the rails 61 are connected by two or more parallel, extendible and retractible braces 65. However, and as also previously described, although the braces may also be of identical construction, the means by which their opposite ends are connected to the rails do not permit the device to fold, and in fact maintain the braces substantially perpendicular to the rails as the braces are lowered into and raised from the trench T. Thus, as previously mentioned, each of the devices of the type shown in FIGS. 6 to 10 is handled mechanically rather than individually, whereby it is unnecessary to fold it in the manner described in connection with the device of FIGS. 1 to 5.

As previously described, except for structural changes arising from this difference in function of the means for connecting the ends of the braces to the rods, each such connecting means is similar in many respects to the means for connecting the ends of the braces to the rails of the device of FIGS. 1 to 5. Thus, each includes an H-shaped support pad 67 having side flanges 68 connected by a web 68B and extending past the side edges of the narrow inner flange of the rail to dispose the outer edges of the flanges adjacent the inner side of the outer rail, and dispose the inner side of the web 68B substantially adjacent the outer side of the inner flange of the rail. More particularly, the pad is mounted on the rail in this position by means of a pin 69 which extends loosely through holes in the flanges of the support pad and the web of the rail, as shown in the drawings.

The support pad differs from the previously described embodiment in that the socket 70 thereof for receiving the adjacent reduced end 42 of the brace section is welded directly to the outer side of the web 68B of the support pad. More particularly, the reduced end of each brace section is releasably connected to the support pad by means of a pin 72 which extends loosely through holes 73 in the reduced brace end 71 and holes 74 in the socket 70 so as to dispose the end surface of the reduced end 71 of the brace closely adjacent the outer side of the support pad web within the socket 70, and thus prevent the brace from swinging out of its substantially perpendicular position with respect to the rails. The outer ends of pins 72 also extend through enlarged holes 75 in the side flanges of the support pad and are retained therein by means of washers 76 at each end held tightly against the outer sides of the flanges by means of cotter pins or the like.

Due to the enlarged holes in the webs of the rails as well as the sockets of the support pads of the devices of FIGS. 6 to 10, the extension of the braces, upon the supply of pressure fluid thereto (as will be described), will transfer the load of the brace to the rails so as to force the rails tightly against the sides of the trench without imposing substantial shear loads on the pins. Thus, as above described, load is transmitted to the flanges of the rails in much the same manner as they are transmitted in connection with the devices of FIGS. 1 to 5.

Each of the braces 65 is also of substantially the same construction as each of the braces 22 of the first described device. Thus, as best shown in FIGS. 7 and 8, the left hand sections 65A of the brace includes a cap 77 on the outer end of which reduced end 71 is formed to fit within the socket 70, and to the right hand of which is threadedly connected a cylinder 78 which, as shown in FIG. 8, extends toward the opposite end of the brace. The right hand section 65B of the brace includes a rod 79 whose outer end 71 is adapted to fit within the collar 70 of the means for connecting the right hand end of the brace to the right hand rail, and a piston (not shown) on the left hand end of the rod for sealably sliding within the cylinder 78. As in the case of the brace 22, a pressure chamber is formed on the brace between the left hand side of the piston and the end of the cap 77. Pressure fluid may be supplied to or exhausted from the chamber in an obvious manner.

As was also the case in the devices of FIGS. 1 to 5, the cylinder 78 is surrounded by a guard sleeve 80 which surrounds a substantial length of the cylinder, when the brace is extended. More particularly, and as shown in FIGS. 8, 9 and 10, the right hand end of the guard sleeve extends beyond the right hand end of the cylinder 78 and fits between the collar 70 and the side flanges 67 of the support pad. Holes 81 formed in the guard sleeve loosely receive the pins 72, so as to limit the axial movement of the guard sleeve with respect to the brace.

From the foregoing it will be understood that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. A trench shoring device, comprising a pair of elongate rails of "I"-beam shape each including a relatively wide outer flange and a relatively narrow inner flange connected by a web, at least one cross brace including axially extendible and retractible sections one of which has a cylinder and the other of which has a piston sealably slidable in the cylinder to form a variable volume chamber on one side of the piston, and means for releasably connecting one section of each brace to one rail and the other section thereof to the other rail for disposal perpendicularly therebetween, whereby, upon lowering of the device to the trench and the supply of pressure fluid into said chamber to extend the brace, the outer flanges of the rails are urged tightly against the sides of the trench, each connecting means comprising a support pad 28 of generally "H"-shape having side flanges connected by a web, means for releasably mounting the pad on the rail with the web of the pad extending laterally across and adjacent the inner side of the inner flange of the rail and the side flanges of the pad extending past the end edges of the inner flange of the rail to dispose the outer edges of the side flanges of the pad adjacent the inner side of the outer flange of the rail, a socket on the inner side of the web of the pad to receive the outer free end of the brace section, means for releasably connecting the outer free end of the brace section to the support pad, when said end is so received in the socket, so that, upon extension of the brace, the ends of the brace sections are forced against the inner walls of the sockets and the webs of the support pads are forced against the inner flanges of the rails, whereby compressive force due to extension of the brace is transferred to the outer flanges of the rails through both the webs of the rails and the side flanges of the pads, and a load transfer block on the outer end of the socket to dispose the inner side of the block adjacent the end of the brace section, the outer side of the block having a flat portion which is essentially flush with the outer side of the web of the pad, when the brace is perpendicular to the rails, and a curved portion which permits the block to rotate with respect to the pad as the brace is swung into and out of a folded position with respect to the rails when pressure fluid is exhausted from the chamber.

2. A trench shoring device, comprising a pair of elongate rails of "I"-beam shape each including a relatively wide outer flange and a relatively narrow flange connected by a web, at least one cross brace including axially extendible and retractible sections one of which has a cylinder and the other of which has a piston sealably slidable in the cylinder to form a variable volume chamber on one side of the piston, and means for releasably connecting one section of each brace to one rail and the other section thereof to the other rail for disposable perpendicularly therebetween, whereby, upon lowering of the device to the trench and the supply of pressure fluid into said chamber to extend the brace, the outer flanges of the rails are urged tightly against the sides of the trench, each connecting means comprising a support pad of generally "H"-shape having side flanges connected by a web, a first pin adapted to extend loosely through holes in the side flanges of the pad and the web of the rail in order to mount the pad on the rail with the web of the pad extending laterally across and adjacent the inner flange of the rail and the side flanges of the pad extending past the end edges of the inner flange of the rail to dispose the outer edges of the side flanges of the pad adjacent the inner side of the outer flange of the rail, a socket on the inner side of the web of the pad to receive the end of the brace section, a second pin adapted to extend loosely through holes in the socket and the end of the brace section received within the socket in order to releasably connect said end to the pad with the end surface of the brace adjacent an inner wall of the socket, so that, upon extension of the brace, the end surfaces of the brace sections are forced against the inner walls of the sockets and the webs of the support pads are forced against the inner flanges of the rails, whereby compressive force due to extension of the brace is transferred to the outer flanges of the rails through both the webs of the rails and the side flanges of the pads, and a load transfer block on the outer end of the socket to dispose the inner side of the block adjacent the end of the brace section, the second pin also extending loosely through holes in the side flanges of the support pad, and the outer side of the block having a flat portion which is essentially flush with the outer side of the web of the pad, when the brace is perpendicular to the rails, and a curved portion which permits the block to rotate with respect to the pad as the brace is swung into and out of a folded position with respect to the rails when pressure fluid is exhausted from the chamber.

* * * * *